US005581267A

United States Patent [19]

Matsui et al.

[11] Patent Number: 5,581,267

[45] Date of Patent: Dec. 3, 1996

[54] GAUSSIAN-BEAM ANTENNA

[75] Inventors: Toshiaki Matsui, Tokyo; Masahiro Kiyokawa, Musashi-Murayama, both of Japan

[73] Assignee: Communications Research Laboratory, Ministry of Posts and Telecommunications, Koganei, Japan

[21] Appl. No.: 289,208

[22] Filed: Aug. 12, 1994

[30] Foreign Application Priority Data

Jan. 10, 1994 [JP] Japan ..... 6-012179

[51] Int. Cl.[6] ..... H01Q 19/10

[52] U.S. Cl. ..... 343/837; 343/753; 343/709

[58] Field of Search ..... 343/837, 909, 343/756, 753, 834, 838, 836, 781 R, 781 P, 781 CA; H01Q 19/10

[56] References Cited

U.S. PATENT DOCUMENTS 4,054,874 10/1977 Oltman, Jr. ..... 343/700 MS 4,063,246 12/1977 Greiser ..... 343/700 MS 4,426,649 1/1984 Dubost et al. ..... 343/700 MS 5,012,212 4/1991 Matsui et al. ..... 333/227

*Primary Examiner*—Hoanganh Le

*Attorney, Agent, or Firm*—Oblon, Spivak, McClelland, Maier, & Neustadt, P.C.

[57] ABSTRACT

A Gaussian-beam antenna invention comprises a transmitting circuit or a receiving circuit, a resonator consisting of a pair of reflecting mirrors, which consist of a spherical mirror and a planar mirror or two spherical mirrors, and a transmission line which transmits a high-frequency signal between the aforesaid transmitting circuit or receiving circuit and the resonator, one reflecting mirror of the resonator having an electromagnetic wave coupling region constituted as a circular partially transparent mirror surface region having its center on the optical axis.

13 Claims, 12 Drawing Sheets

GAUSSIAN-BEAM ANTENNA

BACKGROUND OF THE INVENTION

1. Field of the Invention:

This invention relates to a resonant aperture antenna of quasi-planar structure, more particularly to such an antenna which exhibits Gaussian-beam apertured surface power distribution in the microwave-to-submillimeter wave region.

2. Description of the Prior Art:

An antenna for radiating electromagnetic waves into space and receiving electromagnetic waves from space is designed to radiate electromagnetic waves by efficiently transforming oscillating electromagnetic energy into electromagnetic waves which propagate into space through a wave path and to efficiently transform electromagnetic waves propagating through space into energy transmitted through the wave path. In cases where the electromagnetic field radiated by an antenna is considered to be produced as a spatially extending planar electromagnetic field, the antenna is referred to as an aperture surface antenna. The different types of apertured surface antenna include the horn antenna, reflector antenna and lens antenna.

The horn antenna is obtained by gradually flaring the section of a rectangular or circular antenna to the required aperture. The wave front at the aperture is curved and for reducing the deviation from this plane to a small value relative to the wavelength it is necessary to set the opening angle of the horn at an appropriate angle. In addition to being independently usable as an antenna with a gain of about 20 dB, the horn antenna can also be used as the primary radiator of a reflector antenna or a lens antenna. A characteristic of the horn antenna is its good impedance characteristics over a wide frequency range.

The pyramid horn antenna is an antenna obtained by gradually flaring a rectangular waveguide and is excited in the $TE_{01}$ mode, which is the fundamental mode of the rectangular waveguide. The $TE_{01}$ mode can be considered to appear without modification in the amplitude distribution of the apertured surface and the phase distribution can be determined as the deviation of the wave front. The radiation pattern of the pyramid horn antenna differs between the E plane and the H plane.

The diagonal horn antenna, which has a rectangular aperture, is a horn excited by a wave that is a composite of the $TE_{01}$ and $TE_{10}$ modes of a rectangular waveguide, and since the distribution in the lateral and longitudinal planes is identical in both modes, an isotropic beam can be obtained.

The conical horn antenna is what is obtained by gradually flaring a circular wave guide and is excited in the $TE_{11}$ mode, which is the fundamental mode of a circular waveguide. Since the conical horn is rotationally symmetrical, it is useful in cases where the plane of polarization changes. The amplitude distribution of the apertured surface can be regarded to be the same as that in $TE_{11}$ mode and the phase distribution can be determined as a spherical wave whose center is at the apex of the cone.

The rotary parabolic reflector antenna, ordinarily referred to as the parabolic antenna, is an antenna which uses a portion of a rotary parabolic surface as a reflector. This antenna is ordinarily employed as a 30~50 dB high-gain antenna and is used in combination with a primary radiator located at the focal point F of the parabolic surface. The reflecting mirror surface functions to transform a spherical wave into a plane wave. A small-aperture pyramid horn, small-aperture conical horn, dipole with reflection plate or the like is used as the primary radiator.

An antenna consisting of two reflecting mirrors, namely, a main reflecting mirror and an auxiliary reflecting mirror, and a primary radiator is referred to as a double reflecting mirror antenna. One that, like the Cassegrain optical telescope, uses a parabolic surface in the main reflecting mirror and a hyperbolic surface in the auxiliary reflecting mirror is referred to as a Cassegrain antenna. A horn antenna is ordinarily used as the primary radiator. One of the two focal points of the auxiliary reflecting mirror is coincident with the focal point of the main reflecting mirror and the other is located to be coincident with the phase center of the primary radiator.

The auxiliary reflecting mirror of the Cassegrain antenna is used as a spherical wave transformer between the primary radiator and the main reflecting mirror. As characteristics of this antenna there can be mentioned, inter alia, that by turning back the electromagnetic beam at the auxiliary reflecting mirror the primary radiator can be positioned near the apex of the main reflecting mirror, whereby (1) the power supply line can be shortened and (2) it is possible by applying mirror surface correction to the two reflecting mirrors to increase the efficiency and reduce the noise of the antenna as a whole, and that owing to the use of the auxiliary reflecting mirror the composite focal distance can be made large, whereby (3) the cross polarization component produced by the reflecting mirror system can be reduced and (4) the range is broad since a primary radiator with a large aperture can be used.

In the parabolic antenna using a rotationally symmetrical parabolic reflecting mirror as its main reflecting mirror, the Cassegrain antenna and the Gregorian antenna, it is necessary to provide a primary radiator, a feed line thereof and an auxiliary reflecting mirror in front of each reflecting mirror. These obstruct the transmission line and are a cause for degradation of the radiation characteristics. As a method for avoiding this, there exist offset antennas, known as the offset parabola antenna, the offset Cassegrain antenna and the offset Gregorian antenna, which use an off-axis parabolic mirror and position the primary radiator or the auxiliary reflecting mirror outside the aperture. These are used for achieving low sidelobe.

Although the various horn antennas have good impedance characteristics over a broad frequency region, technologies have been developed for improvement regarding sidelobe characteristics and axial symmetry. The so-called corrugated horn having a large number of thin fins provided concentrically on the inner wall of a conical horn possesses an axially symmetrical beam and good cross polarization characteristics over a frequency region of about one octave. This horn propagates the $EH_{11}$ mode, which is one of the hybrid modes of the corrugated circular waveguide, and when the height of the corrugated waveguide fins is about ¼ wavelength, the aperture electric field distribution of the $EH_{11}$ mode becomes Gaussian distribution-like in the radial direction, thus establishing an axially symmetrical configuration with no variation in the circumferential direction, whereby the directionality of the excited corrugated horn exhibits low sidelobe and little cross polarization component. Owing to its structural complexity, however, a large-aperture corrugated horn is heavy, has many problems in terms of both fabrication technology and cost, and is used only for special purposes. Moreover, in the millimeter wave region where antennas are made small in size, there are difficulties in fabrication technology which make it impracticable at short-millimeter wave and higher frequencies.

On the other hand, thin-film planar circuit technology is expanding from the microwave into the millimeter wave technology region. In cases where an attempt is made to obtain high gain with a planar antenna, array antenna technology is widely used in the microwave region. In multi-element antennas in the millimeter wave-short millimeter wave region above several tens of GHz, however, there is a difficult situation in which practical utilization is not possible because, owing to feed line propagation loss, increasing the number of elements for obtaining sharp directionality leads to a rapid decrease in radiation efficiency.

Many of the prior art antennas described in the foregoing are used mostly in the microwave and lower frequencies and face difficulties in terms of fabrication technology when an attempt is made to use them as millimeter wave-submillimeter wave region antennas. In the millimeter wave and higher frequency range, treatment as a beam becomes important and a new antenna possessing a low sidelobe characteristic and high radiation efficiency is desired. In addition, it is considered that the conventional millimeter wave devices constituted mainly with waveguide technology will be replaced with millimeter monolithic integrated circuits (MMIC) in the near future. For wide and general dissemination of millimeter wave utilization, a need has arisen for the development of a new antenna appropriate for combination with these planar circuit technologies.

With the prior art technologies described in the foregoing it is difficult to achieve sharp directionality and low sidelobe characteristics as well as high antenna radiation efficiency. In particular, at millimeter wave and higher frequencies, there are many cases in which treatment as a quasi-optical beam is advantageous, and in such a case, the efficiency of the antenna for transforming from the guided wave mode to a spatial beam (the radiation efficiency) becomes extremely important. Moreover, the asymmetry in directionality and the sidelobe of the primary radiator used in combination with the reflector antenna are direct causes for degradation of the efficiency and noise characteristics of the whole antenna. On the other hand, a new antenna device is desired for realizing functional millimeter wave utilization technology combined with microwave integrated circuit technology based on recent thin-film device technology.

The present invention was accomplished in the light of the foregoing circumstances and resides in the provision of a new Gaussian-beam antenna usable in the microwave-to-submillimeter wave region, which in addition to possessing high antenna efficiency, high axial symmetry and low sidelobe characteristics and being able to readily achieve a high antenna gain is further suitable for configuring a compact transmitter which has a quasi-planar structure and is combined with thin-film integrated circuit.

SUMMARY OF THE INVENTION

For achieving this purpose, the Gaussian-beam antenna according to this invention comprises a transmitting circuit or a receiving circuit, a resonator consisting of a pair of reflecting mirrors, which consist of a spherical mirror and a planar mirror or two spherical mirrors, and a wave path which transmits a high-frequency signal between said transmitting circuit or receiving circuit and said resonator, one reflecting mirror of said resonator having an electromagnetic wave coupling region constituted as a circular partially transparent mirror surface region having its center on the optical axis, the other reflecting mirror having a strip element and on the rear surface of said strip element having a coupling region for coupling with said transmission line, the reflection losses at said pair of reflecting mirrors constituting said resonator and at the mirror surfaces being the same with respect to the fundamental resonance mode.

In addition, the Gaussian-beam antenna according to this invention may be one in which the circular partially transparent mirror surface region provided on the reflective mirror surface of one of said pair of reflecting mirrors as an electromagnetic wave coupling region coupling with free space is a reflective mirror surface consisting of a two-dimensional grid-like conductor pattern that is fine in comparison with the wavelength, the rear surface of the strip element constituting a region of the other reflective mirror surface is provided thereon with a coupling region for coupling with the transmission lines of high-frequency signals corresponding to two perpendicularly intersecting polarization components, said coupling region is connected with two transmission line systems, and the electrical length between said coupling region and the branch point where the two transmission lines are transformed into a single transmission line is the length which creates a 90 degree difference in the phase angle between the high-frequency signals of said two systems.

In addition, the Gaussian-beam antenna may be one having a structure equivalent to one in which a low-loss dielectric is charged between said pair of reflective mirror surfaces. In addition, the coupling region provided on said one reflective mirror surface for coupling with the transmission line of the high-frequency wave electromagnetic field may be a coupling with any of a metallic waveguide, a coaxial transmission path, a strip line and a coplanar planar wave path.

In accordance with the antenna of the aforesaid configuration, the high-frequency signal transmitted by the transmission line passes through the coupling region for coupling with the transmission line of the high-frequency signal which is provided on the rear surface of the conductor reflecting mirror surface region (the strip element) and constitutes one of the reflective mirror surface regions, induces high-frequency current in the strip element constituting said one reflective mirror surface region, said high-frequency current on said strip element is radiated within the resonator constituted by disposing the pair of reflecting mirrors consisting of a spherical mirror and a planar mirror to face each other so that the waves reflected from the two mirror surfaces repeatedly superimpose, a stable electric field distribution is formed along the axis by the condensing action of the spherical mirror when the interval between said pair of reflective mirror surfaces produces a phase difference that is an integral multiple of $2\pi$, a resonant mode is excited which is manifested as a Gaussian beam in which the energy distribution of the electromagnetic waves is high near the center axis in the direction of electromagnetic wave propagation and decreases rapidly with separation from such axis (fundamental mode $TEM_{00q}$; qt1 being an integer indicating the longitudinal mode number), a large high-frequency wave electromagnetic field energy is accumulated, as a part thereof an electric power equal to the high-frequency signal supplied from the transmission line to the coupling region is released from the circular partially transparent mirror surface region which is provided on the other reflective mirror surface forming said resonator and constitutes an electromagnetic wave coupling region for coupling with free space and is radiated into space in the form of a Gaussian beam, whereby the antenna is in principle a low sidelobe antenna owing to the fact that the apertured surface power distribution thereof is Gaussian, while, in reverse, there can be realized a low sidelobe antenna which operates as a receiving antenna which transforms a received beam to guided wave mode when electromagnetic waves impinging on said partially transparent mirror surface region from space are of a frequency coinciding with the resonant frequency of said resonator and the beam is received at an angular direction enabling the Gaussian beam mode to be excited in the resonator.

According to the antenna of the aforesaid configuration, moreover, it is possible to set the phase angle between the perpendicular polarization components at 90 degrees and realize an antenna which can selectively transmit or receive a clockwise or counterclockwise circularly polarized wave.

The other objects and characteristic features of the invention will become apparent from the description of the invention given hereinbelow with reference to the accompanying drawings.

BRIEF EXPLANATION OF THE DRAWING

FIG. 6(*b*) is a view showing another pattern of the electromagnetic wave coupling region of FIG. 6(*a*).

FIG. 7(*b*) is an explanatory view schematically showing a second embodiment of the form of the strip element.

FIG. 7(*c*) is an explanatory view schematically showing a third embodiment of the form of the strip element.

FIG. 7(*d*) is an explanatory view schematically showing a fourth embodiment of the form of the strip element.

FIG. 7(*e*) is an explanatory view schematically showing a fifth embodiment of the form of the strip element.

FIG. 7(*f*) is an explanatory view schematically showing a sixth embodiment of the form of the strip element.

FIG. 8(*b*) is an explanatory view schematically showing a second embodiment of the strip element.

FIG. 8(*c*) is an explanatory view schematically showing a third embodiment of the strip element.

FIG. 8(*d*) is an explanatory view schematically showing a fourth embodiment of the strip element.

FIG. 8(*e*) is an explanatory view schematically showing a fifth embodiment of the strip element.

FIG. 8(*f*) is an explanatory view schematically showing a sixth embodiment of the strip element.

FIG. 8(*g*) is an explanatory view schematically showing a seventh embodiment of the strip element.

FIG. 8(*h*) is an explanatory view schematically showing an eighth embodiment of the strip element.

FIG. 13(*b*) is an explanatory view showing the pattern of the electromagnetic wave coupling region of the antenna of FIG. 13(*a*).

FIG. 15(*b*) is an explanatory view showing the coupling state of transmission line in the antenna of FIG. 15(*a*).

FIG. 15(*c*) is an explanatory view showing the pattern of the electromagnetic wave coupling region of the antenna of FIG. 15(*a*).

DESCRIPTION OF THE PREFERRED EMBODIMENT

Figure 1:
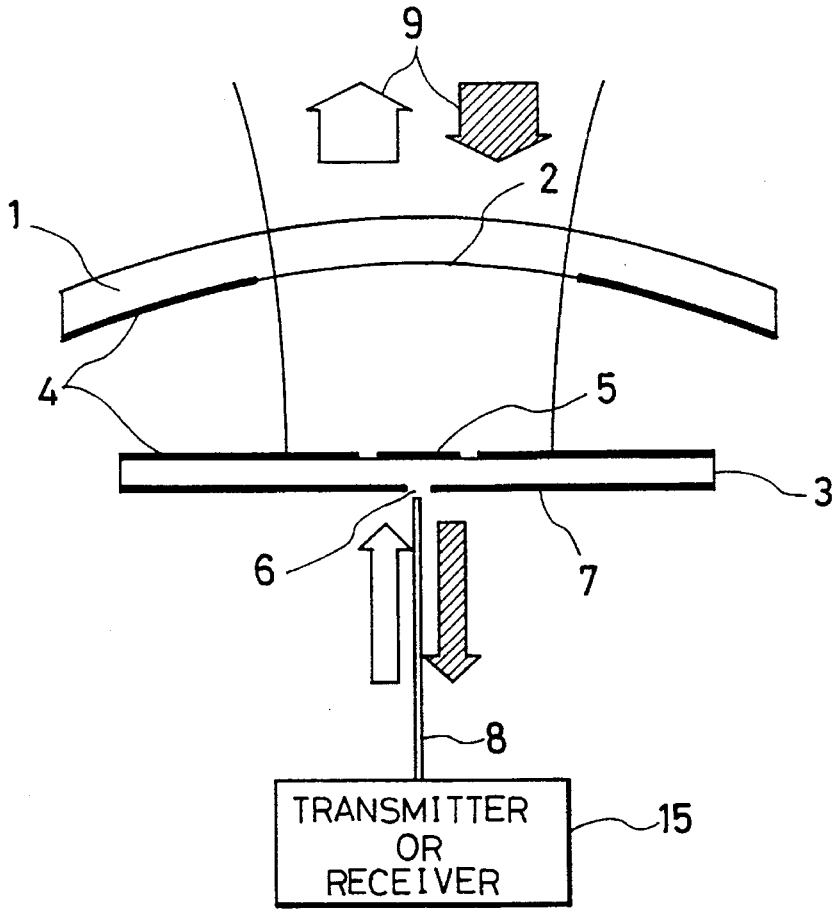
FIG. 1 is an explanatory view showing an embodiment of the Gaussian-beam antenna according to this invention in which the resonator is constituted with a planar reflecting mirror and spherical reflecting mirror.

The Gaussian-beam antenna according to this invention comprises a Fabry-Perot resonator in which a pair of reflecting mirrors consisting of a spherical mirror and a planar mirror or two spherical mirrors are disposed to face each other such that the waves reflected from the two mirror surfaces repeatedly superimpose. FIG. 1 is a view showing one configuration of the Gaussian-beam antenna according to this invention. The antenna according to this embodiment consists of a resonator, which is constituted of a spherical reflecting mirror 1 and a planar reflecting mirror 3, and a wave path 8 for transmitting a high-frequency signal therebetween, the one reflecting mirror 1 of said resonator having an electromagnetic wave coupling region 2 for coupling with space constituted as a partially transparent mirror surface region centered on the optical axis, the other reflecting mirror 3 having a metallic reflecting mirror surface 4, a strip element 5 which constitutes a part of the reflecting mirror 3, and a coupling region 6 on the rear surface of the strip element for coupling with the transmission line 8, the remaining portion of the back surface being constituted as a conductive surface 7, and the reflection losses at the mirror surfaces of said pair of reflecting mirrors 1 and 3 constituting said resonator being the same with respect to the fundamental resonance mode (Gaussian beam mode).

In the case where the aforesaid antenna is used as a transmitting antenna, a high-frequency signal from a transmission circuit (signal source) 15 is transmitted by the transmission line 8 to the coupling region 6 for coupling one reflecting mirror 3 forming the resonator with the transmission line 8, a high-frequency wave current is induced in the strip element 5, the high-frequency wave current is radiated into the resonator, a resonator mode manifested as a Gaussian beam is excited, high-frequency electromagnetic field energy is accumulated, and electric power equal to the high-frequency signal power input from the transmission circuit 15 to the wave path 8 and the coupling region 6 is radiated into space in the form of a Gaussian beam from the electromagnetic wave coupling region 2 for coupling with space constituted by the partially transparent mirror surface region.

Further, in the case where the antenna operates as a receiving antenna, when electromagnetic waves from space impinging on electromagnetic wave coupling region 2 constituted by the partially transparent mirror surface region are of a frequency coinciding with the resonant frequency of said resonator and impinge from an incident angle direction enabling the resonator mode manifested as a Gaussian beam to be excited in said resonator, the high-frequency energy accumulated in the resonator excites high-frequency wave current in the strip element 5 on the reflecting mirror 3 and electric power equal to the high-frequency wave current input to the resonator from the electromagnetic wave coupling region 2 for coupling with space is transmitted through the coupling region 6 disposed on the rear surface of the strip element 5 for coupling with the wave path 8 and through the transmission line 8 to be received by a receiving circuit 15.

Figure 2:
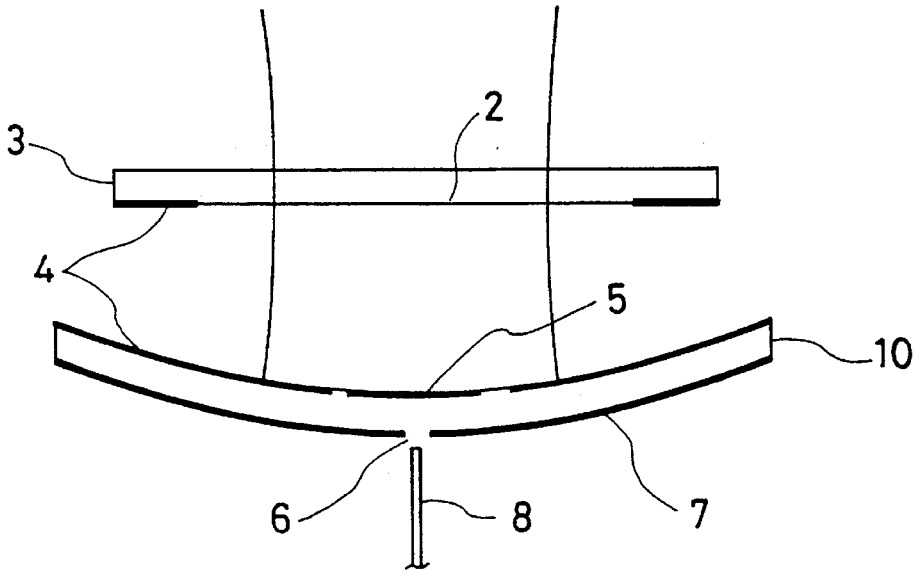
FIG. 2 is an explanatory view showing another embodiment of the Gaussian-beam antenna according to this invention in which the resonator is constituted with a planar reflecting mirror and spherical reflecting mirror.
Figure 3:
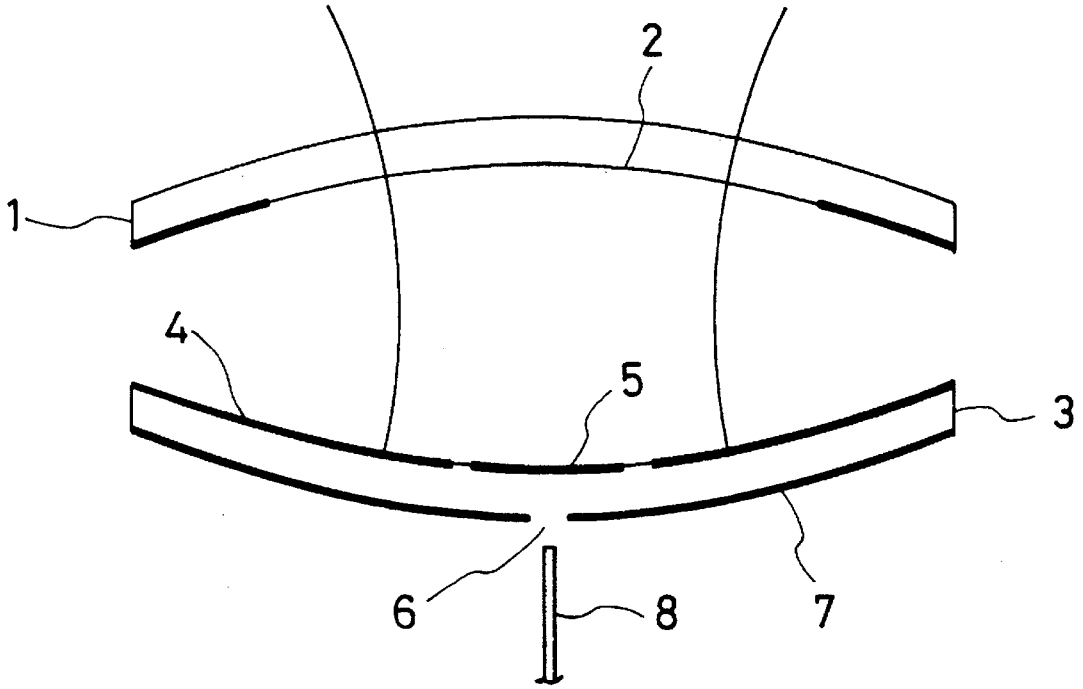
FIG. 3 is an explanatory view showing an embodiment of the Gaussian-beam antenna according to this invention in which the resonator is constituted with a pair of spherical reflecting mirrors.
Figure 4:
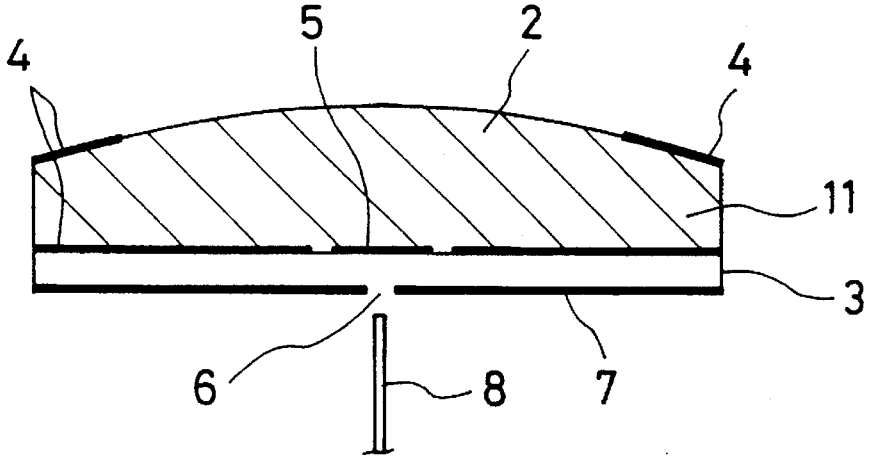
FIG. 4 is an explanatory view showing still another embodiment of the Gaussian-beam antenna according to this invention.
Figure 5:
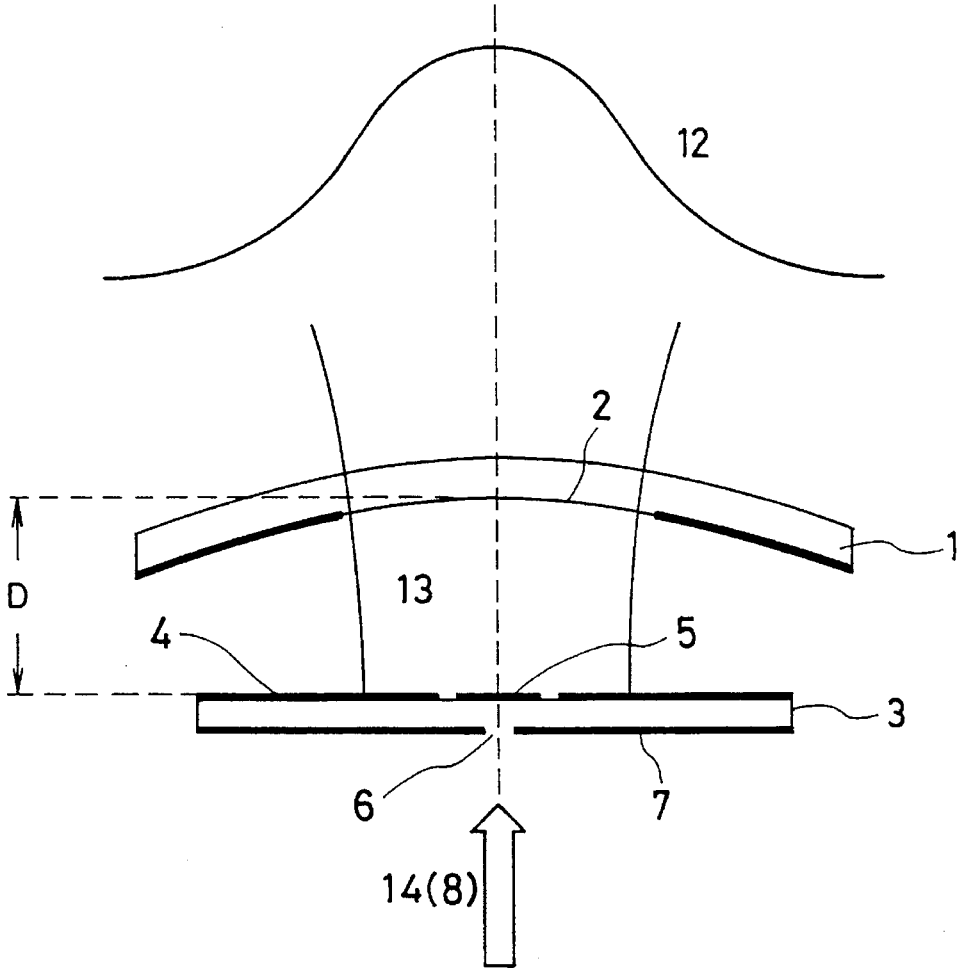
FIG. 5 is an explanatory view schematically showing the power distribution at the apertured surface of a Gaussian-beam antenna according to this invention.

FIG. 2 is a view showing another embodiment of the antenna which is constituted of a spherical reflecting mirror 1 and a planar reflecting mirror 3 and the roles of the mirror surfaces are interchanged. FIG. 3 is a view showing a configuration in which the Gaussian-beam antenna according to this invention comprises two spherical reflecting mirrors 1, 10. Further, FIG. 4 is a view showing a structure equivalent to one in which a low-loss dielectric 11 is charged between the reflecting mirrors 1, 3 of the Gaussian-beam antenna according to this invention. In the configuration of FIG. 4, all or part of the metallic mirror surface portion can be formed integrally on the surfaces of the low-loss dielectric 11 by metal plating, vapor deposition, sputtering or other vacuum film forming method, or by galvanizing or the like. The distribution of the electromagnetic wave energy accumulated in the interior of the Gaussian-beam antenna according to this invention is a Gaussian-beam that is high at the center axis in the direction of electromagnetic wave propagation and decreases rapidly with separation from such axis (fundamental mode $TEM_{00q}$; q being an integer indicating the longitudinal mode number). FIG. 5 shows the schematically represented apertured surface power distribution 12 of the Gaussian-beam antenna according to this invention. At the region of the coupling region 6 coupling with the transmission line and the strip element 5, the mode 14 in the transmission line is converted to the fundamental Gaussian mode 13 of the resonator interior or from the fundamental Gaussian mode 13 to the mode 14 in the transmission line. One reflecting mirror constituting the Gaussian-beam antenna may be either a planar mirror or a spherical mirror and, as shown in the figures, it suffices for one to be a spherical mirror.

As the circular partially transparent mirror surface region 2 constituting the electromagnetic wave coupling region for coupling with free space, the surface of the reflecting mirror on the side for extracting the electromagnetic wave energy accumulated inside the resonator as a beam is provided with a reflective mirror surface consisting of a gird-like conductor pattern that is fine in comparison with the wavelength. As a result of research by the inventors, it was experimentally validated that with a reflective mirror surface such as the foregoing the slight transmittance of the mirror surface possessing high reflectance can be selectively adjusted by varying the dimensions of the conductor pattern (U.S. Pat. No. 5,012,212). The electromagnetic wave energy accumulated inside the resonator is radiated through this partially transparent mirror surface region into free space as a Gaussian beam.

Figure 6A:
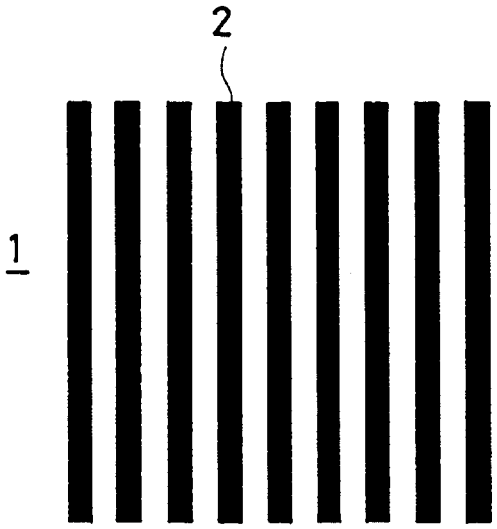
FIG. 6(*a*) is a view schematically showing a metallic grid pattern forming an electromagnetic wave coupling region of one reflective mirror surface of the Gaussian-beam antenna according to this invention.
Figure 6B:
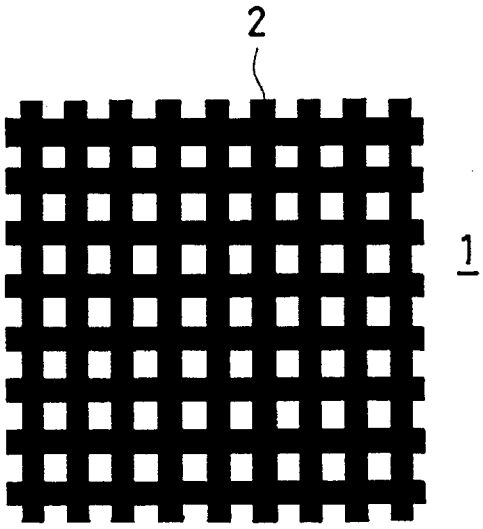
Figure 7A:
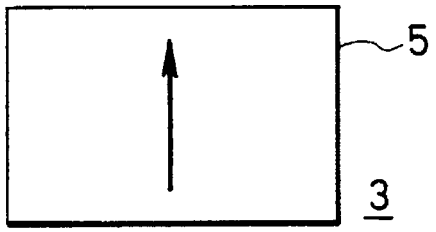
FIG. 7(*a*) is an explanatory view showing a first embodiment of the form of a strip element constituting a coupling region for coupling with a transmission line of the Gaussian-beam antenna according to this invention.
Figure 7B:
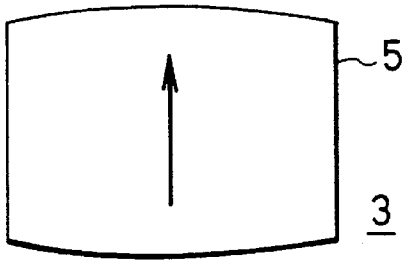
Figure 7C:
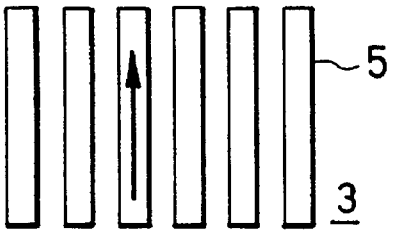
Figure 7D:
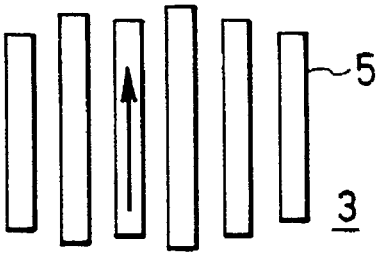
Figure 7E:
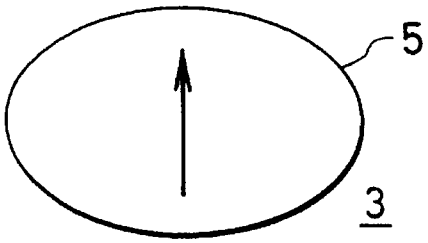
Figure 7F:
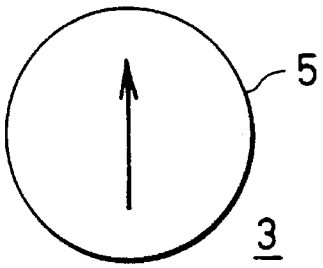
Figure 8A:
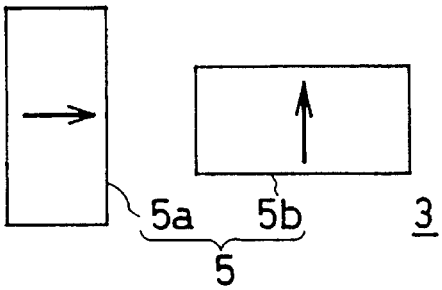
FIG. 8(*a*) is an explanatory view schematically showing a first embodiment of a strip element for use when the Gaussian-beam antenna according to this invention is employed as a circularly polarized wave antenna.
Figure 8B:
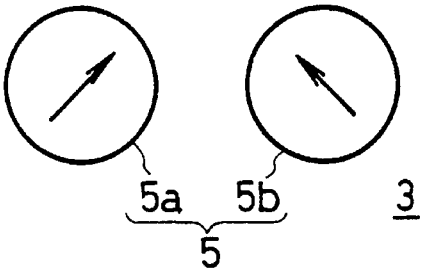
Figure 8C:
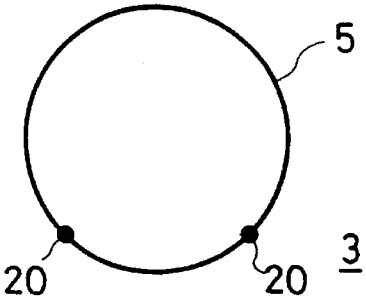
Figure 8D:
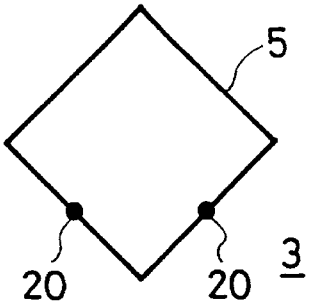
Figure 8E:
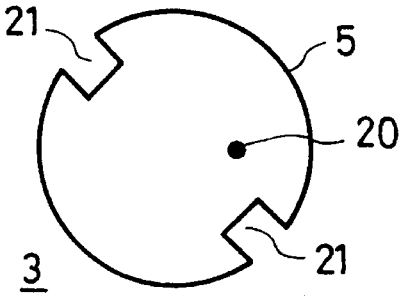
Figure 8F:
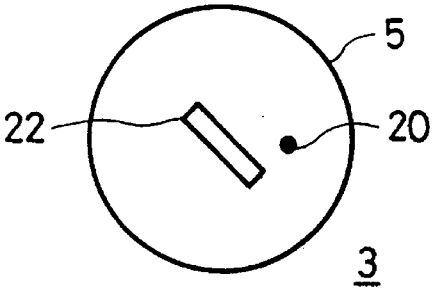
Figure 8G:
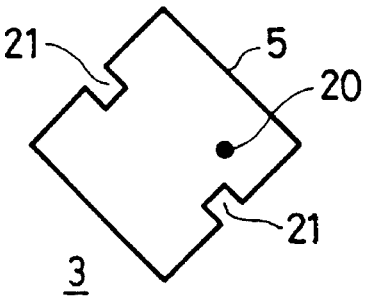
Figure 8H:
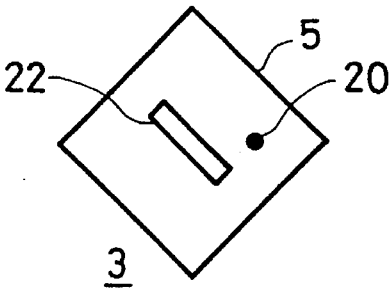

With regard to the partially transparent mirror surface region 2 of the Gaussian-beam antenna according to this invention, for obtaining a high antenna radiation efficiency it is necessary to suppress the absorption loss in mirror surface transmission to a small amount. The effect of transmission absorption at the metallic grid can be made negligibly small by using a good quality metallic mirror surface possessing high conductivity as the raw material, holding the effect of loss owing to finite high-frequency wave surface resistance to the minimum and selecting the grid pattern of the metallic film provided on the surface of the partially transparent mirror surface region 2 at a size in the range of a spatial period of about ¼~1/25 the wavelength, thereby designing such that the effect of the release of the electromagnetic waves from the metallic grid region is governed by the reflectance and using the mirror surface region as one having a transmittance of several percent. FIGS. 6(*a*), (*b*) are views schematically showing metallic grid patterns forming the partially transparent electromagnetic wave coupling region 2. FIG. 6(*a*) shows the concept of a one-dimensional grid pattern and FIG. 6(*b*) shows that of a two-dimensional grid pattern, it of course being possible to use modifications of these as the pattern.

In the case where the reflective mirror surface is a smooth mirror surface made of a metallic conductor with high conductivity such as high-purity copper or aluminum, or gold or silver, the mirror surface reflection loss owing to surface resistive loss can be achieved at less than around 0.1~0.2% in the short millimeter wave region. Further, when the mirror surface of the reflecting mirror is constituted of a Nb, NbN or other metallic superconducting thin film or of a yttrium, bismuth or thallium oxide superconductor, an antenna with even a higher radiation efficiency can be realized in the frequency range in which the surface resistive loss is smaller than a metallic surface with respect to the electromagnetic waves for which the antenna is used. By using these high-quality mirror surface materials and applying thin-film microprocessing techniques it is possible to realize a partially transparent mirror surface 2 with high efficiency extending to the submillimeter wave region.

The Gaussian-beam antenna according to this invention can be viewed as a resonator having two ports. In a Fabry-Perot resonator configured of a pair of concave spherical reflecting mirrors or of a concave spherical reflecting mirror and a planar mirror in the foregoing manner, the effect of the diffractive loss that leaks from the edges of the reflecting mirrors and is lost to the exterior of the resonator at the time of repeatedly reflecting between the mirror surfaces can, by making the opening diameter of the reflecting mirror large, be set at a minute amount that is relatively negligible in comparison with losses accompanying the mirror reflection.

$Q_A$, the antenna Q value in the case where the diffraction loss is negligible, is given by Eq. (1).

$$\frac{1}{Q_A}=\frac{1}{Q_0}+\frac{1}{Q_{C1}}+\frac{1}{Q_{C2}} \tag{1}$$

$Q_0$ here is the unloaded Q corresponding to the surface resistive loss accompanying the formation of the two reflective mirror surfaces forming the resonator of conductor surfaces possessing finite conductivity while, on the other hand, in the case where a coupling region is provided on the reflective mirror surface for extracting energy inside the resonator to the exterior, the extraction of the signal through the coupling region is itself a loss of accumulated electromagnetic wave energy as viewed from the interior of the resonator, and $Q_1$, $Q_2$ represent the coupling Q values which are the Q values corresponding to the amount of increase in loss owing to the provision of the coupling regions on the respective mirror surfaces (referred to as coupling loss).

The coupling coefficients $\beta_1$, $\beta_2$ corresponding to the coupling regions provided on the respective reflective mirror surfaces can be defined as $\beta_1=Q_0/Q_1$, $\beta_2=Q_0/Q_2$. In the Gaussian-beam antenna according to this invention, the transmittances of both reflective mirror surfaces are set high and the antenna Q value, $Q_A$, is set so as to be governed by the coupling Q values, $Q_1$, $Q_2$. $Q_1$, $Q_2$ can be represented using the reflectances $R_1$, $R_2$ of the respective reflective mirror surfaces, as in Eq. (2).

$$Q_k=\frac{4\pi D}{\lambda}\ \frac{\sqrt{R_k}}{1-R_k}\approx 2\pi(q+1)\frac{\sqrt{R_k}}{(1-R_k)} \tag{2}$$

Here, k=1 and 2, and D is the interval between the reflective mirror surfaces. The resonant frequency of the fundamental mode $TEM_{00q}$ at this time can be represented by Eq. (3).

$$f_q=\frac{c}{2D}\ (q+1+\delta) \tag{3}$$

Here, c is the speed of light in the medium inside the resonator, q=0, 1, 2, . . . , and $\delta$ is the correction amount owing to the fact that the propagation of the electromagnetic waves inside the resonator is not a planar wave but a Gaussian beam. $\delta$ depends on the combination of reflecting mirrors and, for a combination of a planar mirror and a spherical mirror is, $\delta=(1/2\pi)$ arccos $(1-2D/R_0)$, and for a combination of two spherical mirrors is given by, $\delta=(1/\pi)$ arccos $(1-D/R_0)$. $R_0$ here is the radius of curvature of the spherical reflecting mirrors.

$\delta$ is ordinarily a small value and the reflective mirror surface interval D is about an integral multiple of ½ the wavelength. Assuming that the mirror surface reflectance is set at about 90~98% and the longitudinal mode number inside the resonator is made 1~5 (q=0, 1, 2, 3, 4), $Q_A$ can achieve 30~1500.

The radiation efficiency, an important characteristic for an antenna, will now be discussed. The power transmittance T in a resonator having two ports is given by Eq. (4), using the coupling coefficients $\beta_1$, $\beta_2$.

$$T=\frac{4\beta_1\beta_2}{(1+\beta_1+\beta_2)^2} \tag{4}$$

For securing a high transmittance as an antenna, it is necessary for the reflectances $R_1$, $R_2$ of the two reflective mirror surfaces to be equal, so that as a result the coupling coefficients $\beta$ are equal, $\beta_1=\beta_2=\beta$, and assume large values.

In the case where a high-conductivity metallic material is used as the conductor forming the reflective mirror surfaces, the unloaded Q value, $Q_0$, assumes a large value and the coupling coefficients given by Eq. (2) assume large values of 10~100, making it possible to realize a high efficiency as the power transmittance T at resonance. In the case where $\beta>>1$ is defined, the power transmittance T becomes 1. With respect to the antenna Q value, $Q_A$=30~1500, an antenna radiation efficiency of 95% or higher is obtained.

Although the shape and beam spread of the Gaussian beam is shown schematically in FIG. 5, the shape of a fundamental Gaussian beam is generally specified by the minimum spot size $w_0$ and the location thereof. In the Gaussian-beam antenna according to this invention, the minimum spot size $w_0$ can be freely set by appropriately selecting the radius of curvature $R_0$ of the spherical reflecting mirror and the reflective mirror surface interval D. The minimum spot size $w_0$ obtained on a planar reflective mirror surface is given by Eq. (5), $$w_o^2=\frac{\lambda}{\pi}\ \sqrt{D(R_0-D)} \tag{5}$$

As a widely known diffraction spread relationship, the half-apex angle in the far field of a wave confined in an aperture of radius $w_0$ is given by Eq. (6)

$$\theta=\tan^{-1}\left(\frac{\lambda}{\pi w_0}\right)\approx\frac{\lambda}{\pi w_0} \tag{6}$$

Thus in the Gaussian-beam antenna according to this invention the antenna radiation pattern can be determined by designing the minimum beam spot size.

Various types of the strip element 5, which plays an important role in the guided wave mode and the resonator mode transformation, will now be discussed. FIG. 7 is a view schematically showing as the strip element 5, which constitutes a part of the metallic reflecting mirror surface 4 of the reflecting mirror 3 provided with the coupling region 6 for coupling with the transmission line 8 of the Gaussian-beam antenna according to this invention, various forms that can be applied for use with linearly polarized waves. FIG. 7(*a*) is the most basic rectangular patch, FIG. 7(*b*) is a patch modified from the shape of FIG. 7(*a*) for band broadening, FIG. 7(*c*) is a conductor grid type, FIG. 7(*d*) is modified in grid length from FIG. 7(*c*) for band broadening, and FIG. 7(*d*) is an elliptical patch which can be expected to have broad band characteristics. These have to be optimized according to the frequency used.

Next, various types of the strip element 5 utilizable when the Gaussian-beam antenna according to this invention is used as a circularly polarized wave antenna are shown in FIG. 8. FIG. 8(*a*) is a pair of rectangular patches consisting of 5*a*, 5*b* for use with a perpendicularly polarized wave, FIG. 8(*b*) is similarly a pair of circular patches for use with a perpendicularly polarized wave, FIG. 8(*c*) is a type that produces a circularly polarized wave by using two power supply points 20 to excite perpendicularly intersecting polarization components and confer a 90-degree phase difference with a single circular patch, and FIG. 8(*d*) similarly produces a circularly polarized wave by using two power supply points 20 to excite perpendicularly polarized waves with a rectangular patch. Each of FIG. 8(*a*), (*b*) (*c*) and (*d*) is required to maintain a 90-degree phase difference regarding the perpendicular polarization components. In contrast, FIG. 8(*e*) is an element which, by providing notches 21 in a circular patch, is devised so that by a single power supply point 20 the current distribution on the patch produces a 90-degree phase difference between perpendicularly intersecting components. In FIG. 8(*f*), instead of providing the notches 21 a slit 22 is provided and the current distribution on the patch and the phase thereof is controlled by a single power supply point, the patch being devised similarly to FIG. 8(*e*) for producing a 90-degree phase difference. FIGS. 8(*g*), (*h*) are types in which notches 21 or a slit 22 is provided with respect to a square patch similarly to the case of the circular patches of FIGS. 8(*e*), (*f*) and a 90-degree phase difference is secured with respect to the perpendicularly intersecting polarization components by selecting the location of a single power supply point. For a circularly polarized wave antenna, the conductor grid of the electromagnetic wave coupling region 2 for coupling with space constituted as a partially transparent mirror surface region at the center of the reflecting mirror 1 combined with and facing the strip element 5 has to be combined with the two-dimensional grid of FIG. 6(*b*).

Aside from the strip elements shown in FIG. 7 and FIG. 8, it is also possible to use a spiral-like conductor film pattern or the like as the strip element for a circularly polarized wave antenna. In addition, a plurality of any of these strip elements can be disposed on one reflective mirror surface. In the case of a large aperture diameter Gaussian-beam antenna, since the coupling with the transmission line becomes weak as a whole, power supply at a plurality of points is effective.

Figure 9:
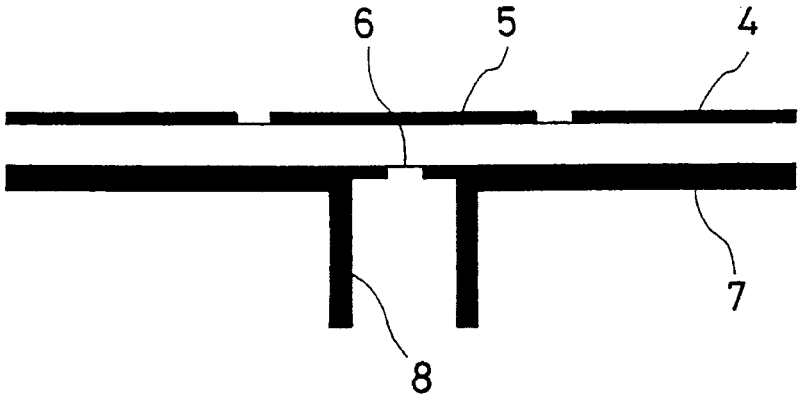
FIG. 9 is an explanatory view schematically showing a coupling region for coupling the Gaussian-beam antenna according to this invention with a metallic waveguide.
Figure 10:
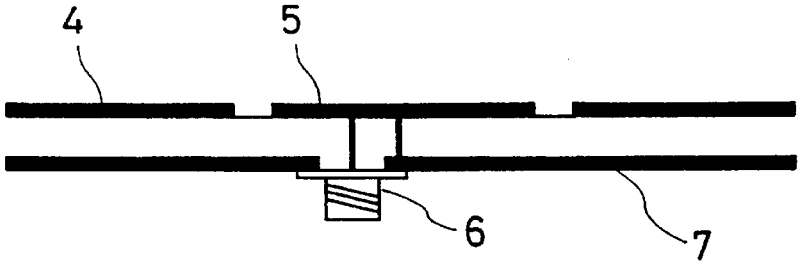
FIG. 10 is an explanatory view schematically showing a coupling region for coupling the Gaussian-beam antenna according to this invention with a coaxial transmission path.
Figure 11:
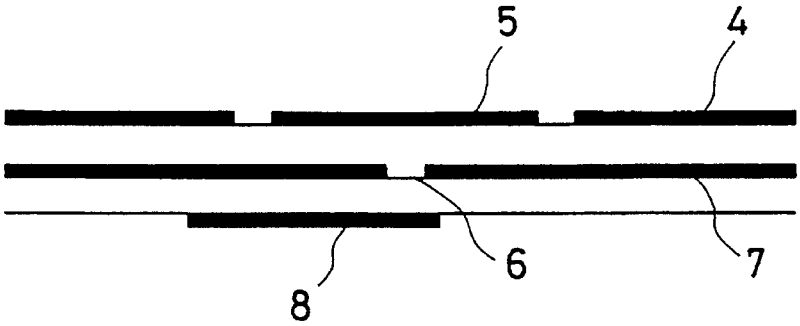
FIG. 11 is an explanatory view schematically showing a coupling region for coupling the Gaussian-beam antenna according to this invention with a microstrip line.
Figure 12:
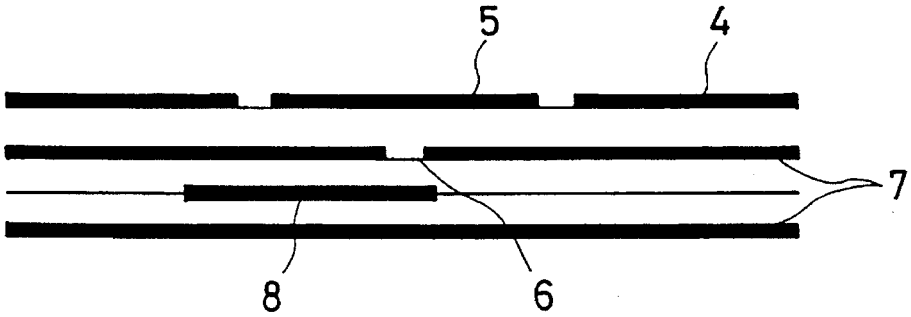
FIG. 12 is an explanatory view schematically showing a coupling region for coupling the Gaussian-beam antenna according to this invention with a triplate structure.

FIG. 9 is an explanatory view schematically showing an example of a coupling region for coupling with a metallic waveguide of the Gaussian-beam antenna according to this invention, and FIG. 10 is an explanatory view schematically showing the coupling region 6 in the case where the transmission line 8 is a coaxial transmission path. Further, FIG. 11 is an explanatory view schematically showing a coupling region for coupling with a transmission line 8 that is a microstrip line, and FIG. 12 and is an explanatory view schematically showing the coupling region 6 connection configuration when the transmission line 8 is a triplate strip line.

Figure 13A:
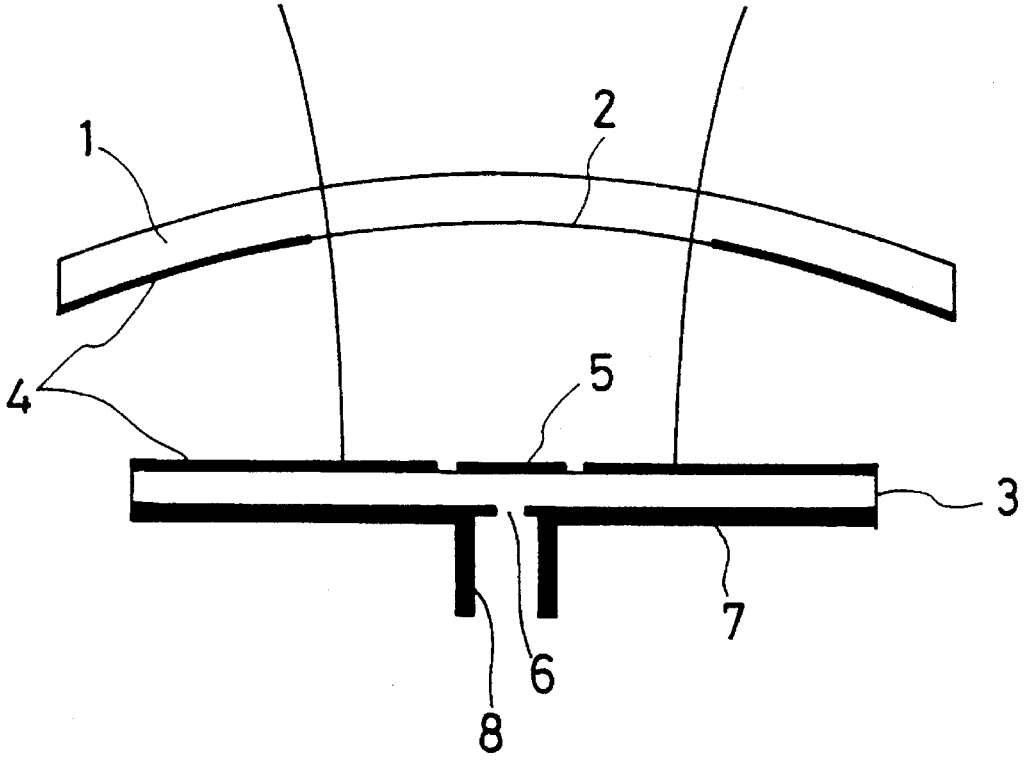
FIG. 13(*a*) is an explanatory view showing the configuration of an embodiment of the Gaussian-beam antenna according to this invention based on metallic waveguide coupling.
Figure 13B:
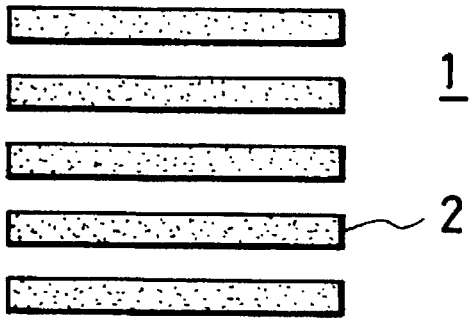

FIG. 13 is a structural view showing an embodiment of the Gaussian-beam antenna according to this invention. A metallic grid is used for making the partially transparent coupling region provided on the spherical reflecting mirror surface a reflective mirror surface with a high reflectance and a low transmission absorption loss. For testing in the X-band, a copper-plated Teflon cloth substrate formed to a diameter of 250 mm was used as the spherical mirror; one heat-formed to a spherical surface of a radius of curvature of 1.2 m is used. The diameter 2a of the partially transparent circular coupling region is 200 mm. The structural parameters of the spherical reflecting mirror are summarized and shown in Table 1.

| | |
|---|---|
| Plane mirror size | 220 × 220 mm |
| Spherical mirror diameter | 250 mm |
| Spherical mirror radius of curvature | 1200 mm |
| Partially transparent mirror surface region | |
| Diameter | 200 mm |
| Conductor portion line width | 1.8 mm |
| Gap width | 2.2 mm |

Figure 14:
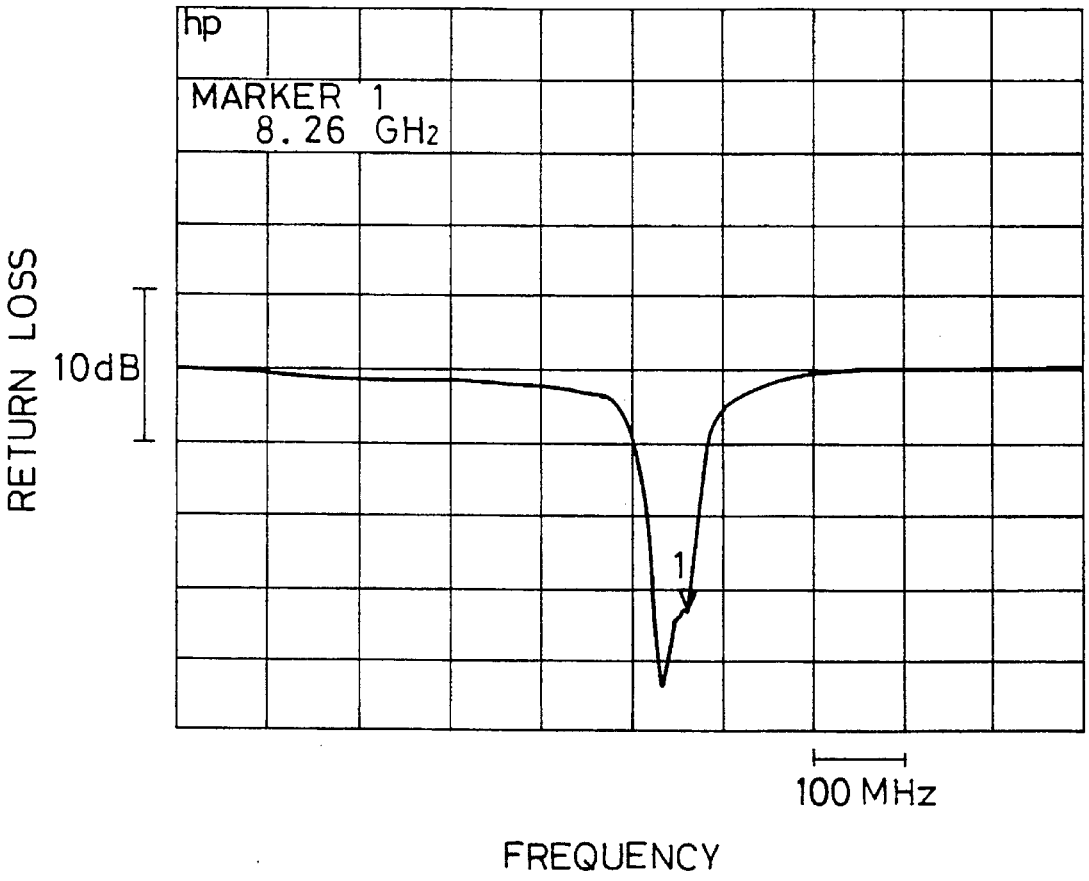
FIG. 14 is a graph showing the return loss measurement results of an embodiment of the Gaussian-beam antenna according to this invention based on metallic waveguide coupling.

The conductor grid pattern 19 of FIG. 7 was used as the strip element 5 which is excited at the waveguide slot coupling region of the Gaussian-beam antenna according to this invention. A copper-plated Teflon cloth substrate was used as the planar reflecting mirror surface, the rear surface of the planar mirror was provided with a slot coupling region at the end surface of an X-band waveguide (WR-b 90: inside dimensions 10.16 mm×22.86 mm), a copper grid, 15 mm length, near one-half wavelength, in the direction of the magnetic field, and 2 mm width, which was positioned near the front surface of the slot coupling region provided on the end surface of the waveguide was disposed in 7 strips at a period of 4 mm, thus providing a conductor reflective mirror surface region constituting a mode transformation coupling region between the transmission line and the resonator in which the copper grid region is excited by electromagnetic waves from the slot coupling region, and a waveguide stub tuner was used behind the waveguide for matching the circuit. The results of antenna return loss measurement using a network analyzer (HP8510B) are shown in FIG. 14.

Figure 15A:
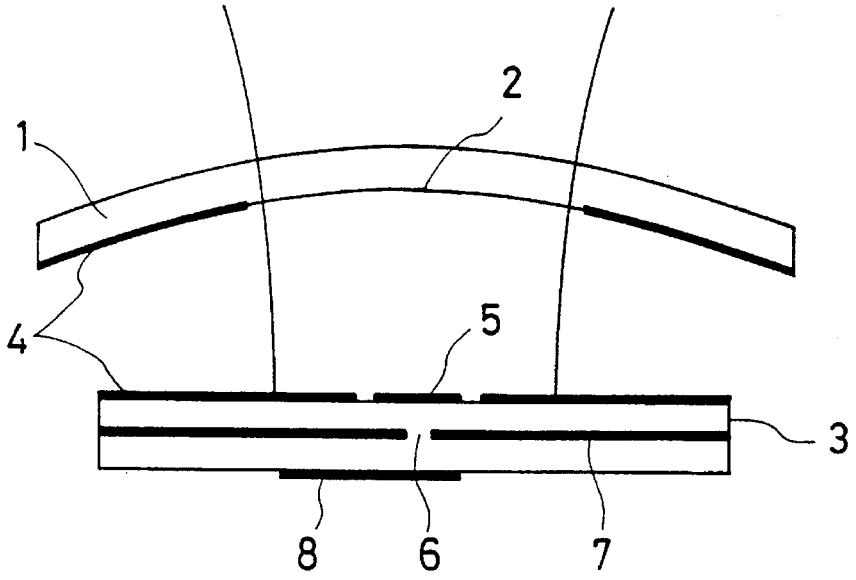
FIG. 15(*a*) is an explanatory view showing the configuration of an embodiment of the Gaussian-beam antenna according to this invention based on planar transmission line coupling.
Figure 15B:
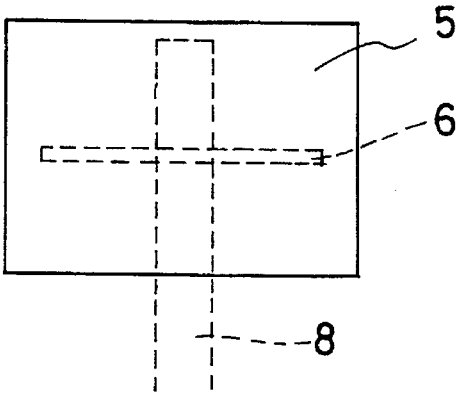
Figure 15C:
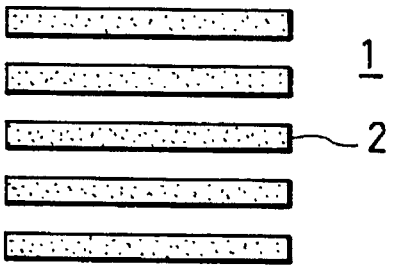
Figure 16:
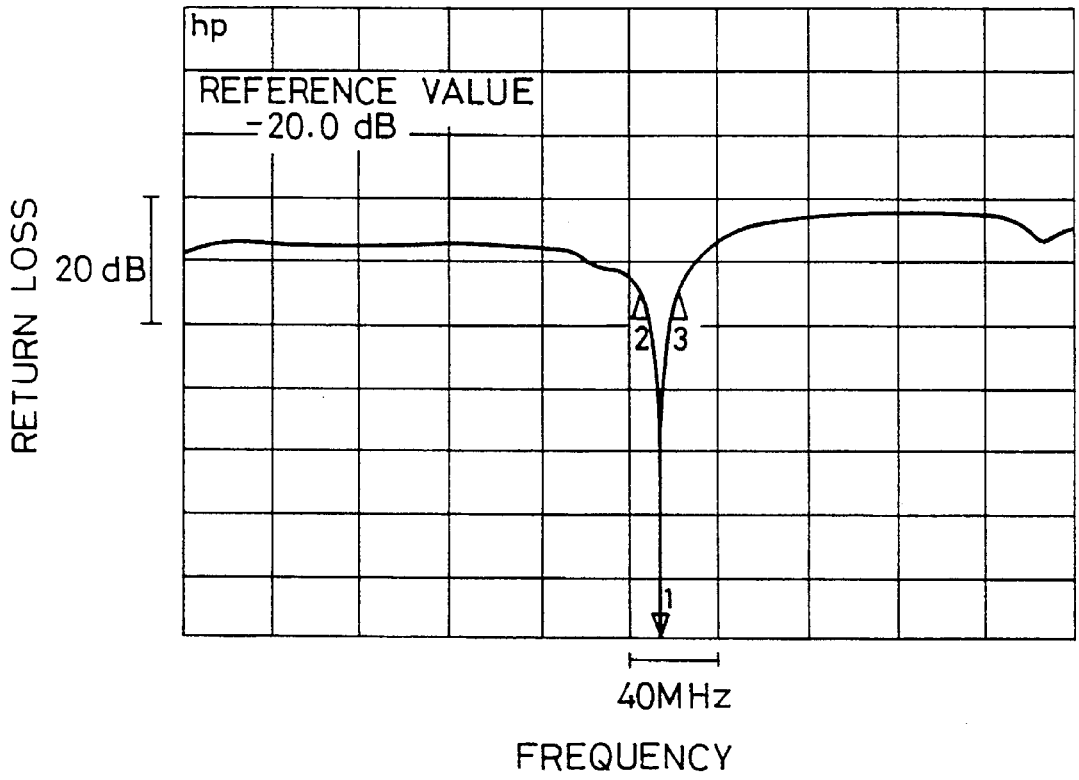
FIG. 16 is a graph showing the return loss measurement results of an embodiment of the Gaussian-beam antenna according to this invention based on planar transmission line coupling

FIG. 15 is a view showing an embodiment of the Gaussian-beam antenna according to this invention based on planar transmission line coupling, which is the same as FIG. 13 in the point that the partially transparent mirror surface region is provided on a spherical reflecting mirror, is configured for the case in which the transmission line is a microstrip line, uses the shape of the rectangular patch 1 of FIG. 7 as the strip element 5 forming a part of the metallic reflective mirror surface which mode transforms between the transmission line and the resonator, and measures 8 mm in length and 12 mm in width. The coupling region 6 is a slot whose length is near ½ wavelength. As the matching circuit was used an open stub whose length was about ¼ the effective wavelength. The results of antenna return loss measurement using a network analyzer (HP8510B) are shown in FIG. 16.

Figure 17:
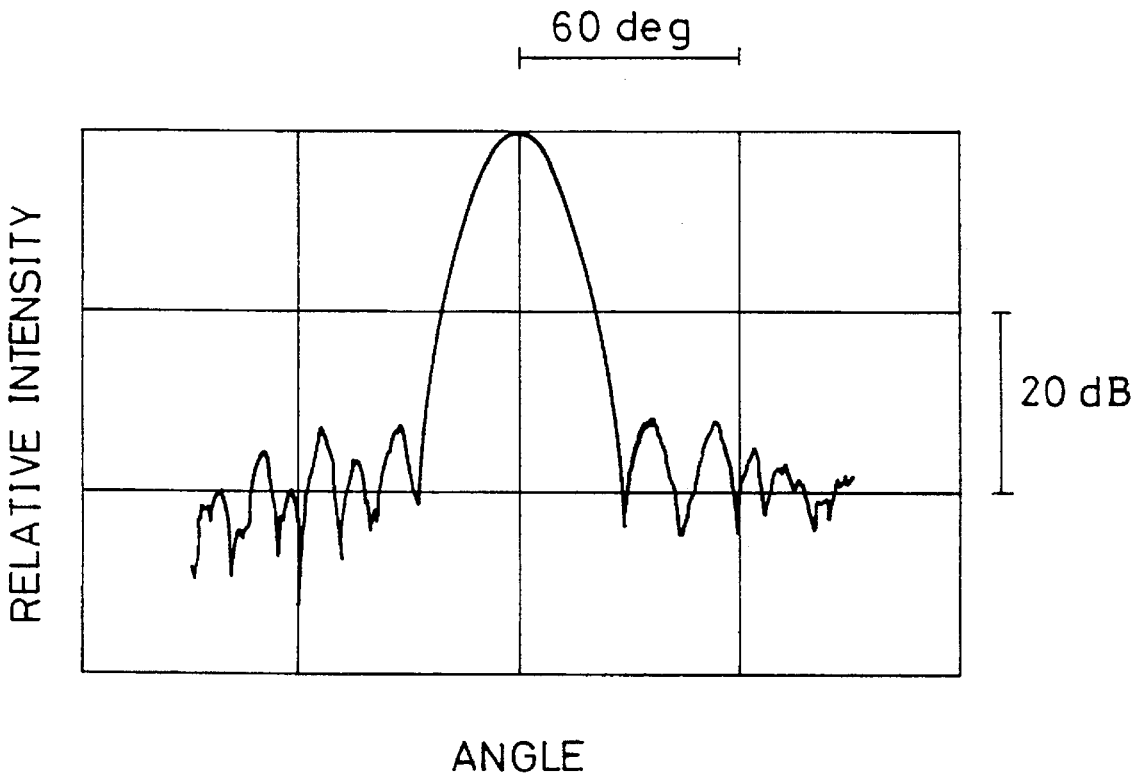
FIG. 17 is a graph showing the antenna radiation pattern measurement results of an embodiment of the Gaussian-beam antenna according to this invention.

The measurement of the radiation pattern of the Gaussian-beam antenna according to this invention was conducted in an anechoic chamber. The antenna being tested was set as a receiving antenna on a rotary stage and the angular dependence of the received power of a transmitted signal from a horn antenna was measured as the angle was changed. FIG. 17 shows the measurement results of the antenna pattern at 8.27 GHz, the vertical axis representing relative gain and the horizontal axis rotational angle. In this measurement, the longitudinal mode corresponds to q=1 and the mirror surface interval is about one wavelength. As a characteristic of a Gaussian beam there is obtained a low sidelobe characteristic. The theoretical values obtained by substituting the radius of curvature $R_0$ of the spherical mirror, the mirror surface interval D and the value of the wavelength $\lambda$ into Eq. 5 and Eq. 6 and the results of the antenna pattern measurement values showed good agreement, experimentally validating that a Gaussian beam is formed inside the resonator, extracted from the partially transparent mirror surface region, and radiated as a wave source at the apertured surface with Gaussian intensity distribution. The ratio of the radius a of the partially transparent mirror surface region to the beam spot size Wo on the spherical mirror was 2.05. The antenna data are summarized in Table 2.

| | |
|---|---|
| Half-power beam width 2θ (when power is reduced to one half) | 16° |
| Half-apex angle θ (when electromagnetic field is reduced to 1/e) | 13.6° |
| Minimum beam spot size $W_0$ (experimental value) | 48.7 mm |
| Minimum beam spot size $W_0$ (theoretical value) | 49.0 mm |
| Aperture ratio $a/w_0$ | 2.05 |

Figure 18:
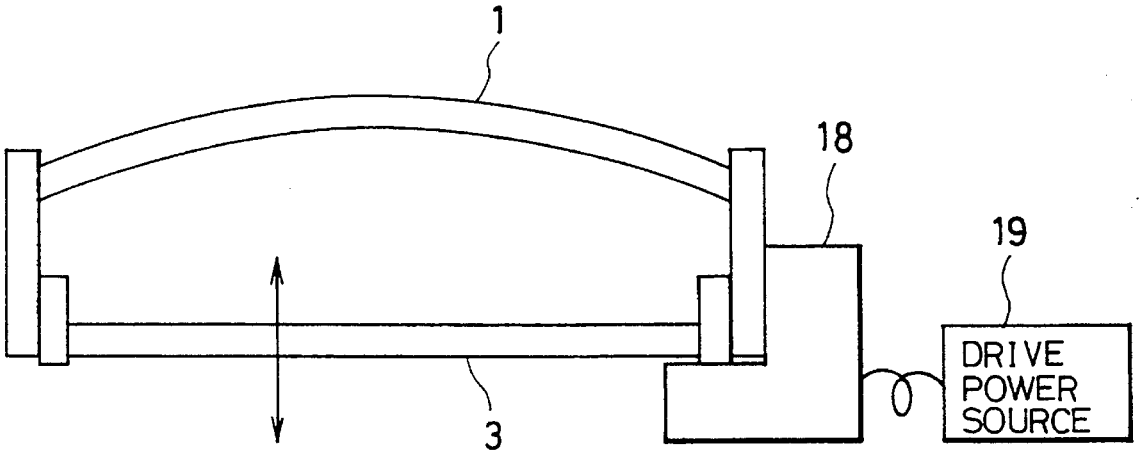
FIG. 18 is an explanatory view showing an embodiment of the Gaussian-beam antenna according to this invention equipped with mirror surface interval adjustment means.

The Gaussian-beam antenna according to this invention is a resonant antenna and possesses frequency selectivity. FIG. 18 is a conceptual view of a configuration for varying frequency selection as an antenna in which the interval between the reflecting mirrors 1 and 3 constituting the resonator is mechanically varied. Although it is possible to vary the interval between the two reflecting mirrors 1 and 3 constituting the resonator by manual sliding, precision driving by a reflecting mirror drive unit 18 based on a signal from a drive power source 19 is also possible. Said frequency variable system varying the mirror surface interval enables matching over a wide range.

Figure 19:
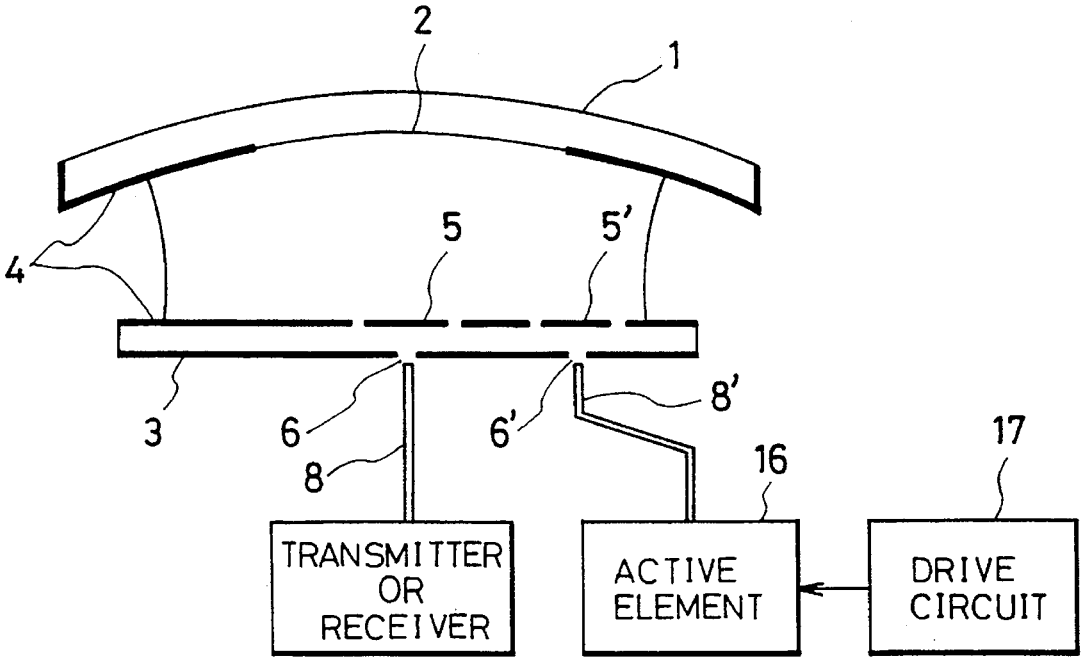
FIG. 19 is an explanatory view showing an embodiment of the Gaussian-beam antenna according to this invention whose resonant frequency is varied by loading with an active element.

In contrast, FIG. 19 shows a method enabling rapid electrical variation, although the range of frequency variation is narrow. In this case, by maintaining the resonator interval constant, providing separately of the transmission line 8 which transmits a high-frequency signal between the transmission circuit or receiving circuit 15 and the strip element 5 another transmission 8' connected with an active element 16 through another strip element 5' and coupling region 6' on the rear surface thereof, and greatly varying the reactance of the active element by a signal from a drive circuit 17, it is possible to equivalently vary the resonant frequency of the resonator slightly.

By the Gaussian-beam antenna technology according to this invention, an electric field with Gaussian distribution at the antenna apertured surface can be realized as desired. As a result, the (1) high axial symmetry and (2) ultra-low sidelobe characteristic possessed by the Gaussian-beam antenna according to this invention are considered effective for improving the overall performance as a primary horn combined with a large antenna and are also extremely effective as quasi-optical beam technologies in the millimeter wave and higher frequency range. In addition, since the present invention is of the type conducting transformation from guided wave mode to resonator mode, the effective apertured surface can be readily enlarged, whereby (3) an antenna with high gain in the millimeter-and submillimeter-wave regions can be realized. Moreover, in accordance with the present invention, (4) there can be realized a high-gain antenna having a quasi-planar structure appropriate for integration with a planar millimeter wave circuit for configuring a compact transmitter/receiver. Further, the Gaussian-beam antenna according to this invention (5) is a resonant antenna with low insertion loss so that when used as an antenna for a high-output transmitter a strong suppressing effect with respect to unnecessary spurious can be expected. There can be realized an ultra-low spurious, low-noise antenna which prevents the local signal of a receiver from leaking from the antenna and being radiated into space as an unnecessary wave.

As set out in the foregoing, in accordance with the present invention not only are the many technical difficulties that have been impossible up to now overcome but utilization in many new fields can also be anticipated.

What is claimed is:

1. A Gaussian-beam antenna comprising:

a transmitting circuit or a receiving circuit;

a resonator consisting of a pair of reflecting mirrors, at least one of said pair of reflecting mirrors being spherical, a gap between reflective mirror surfaces of said pair of reflecting mirrors having a length in the range of ½ to 5/2 a wavelength of a high frequency signal; and a transmission line which transmits a high frequency signal between said transmitting circuit or receiving circuit and said resonator;

one reflecting mirror of said resonator having an electromagnetic wave coupling region constituted as a circular partially transparent mirror surface region having its center on an optical axis, the other reflecting mirror having a strip element constituting a part of a conductive reflective mirror surface thereof and on the rear surface of said strip element having a second coupling agent region for coupling with said transmission line, the two coupling regions having coupling coefficients substantially the same and in the range of 10 to 100 with respect to the fundamental resonance mode.

2. An antenna according to claim 1, wherein said second coupling region is connected with two transmission lines and the electrical length between said second coupling region and a branch point where the two transmission lines are transformed into a single transmission line is the length which creates a 90 degree difference in the phase angle between the high frequency signals of the two transmission lines.

3. An antenna according to claim 1, wherein said transmission line is a metallic transmission line.

4. An antenna according to claim 1, wherein said transmission line is a coaxial transmission line.

5. An antenna according to claim 1, wherein said transmission line is a triplate strip line.

6. An antenna according to claim 1, wherein said transmission line is a microstrip line.

7. An antenna according to claim 1, wherein said transmission line is a coplanar line.

8. An antenna according to claim 1, wherein said pair of reflecting mirrors have conductors made of one member selected from the group consisting of copper, aluminum, gold and superconductors.

9. An antenna according to claim 1, wherein said resonator is equipped with means for adjusting the length of the gap between the reflective mirror surfaces of said pair of reflecting mirrors.

10. An antenna according to claim 1, wherein said one reflecting mirror includes a subsidiary third coupling region other than said second coupling region for coupling with the transmission line, said subsidiary third coupling region coupling with a circuit loaded with an active element.

11. An antenna according to claim 1, wherein said circular partially transparent mirror surface is a reflective mirror surface constituted as a two-dimensional grid-like conductor pattern that is fine in comparison with the wavelength.

12. An antenna according to claim 1, including one having a structure equivalent to one in which a low-loss dielectric is charged between said pair of reflecting mirrors.

13. An antenna according to claim 12, wherein said low-loss dielectric is one member selected from the group consisting of sapphire, quartz, magnesium, silicon, gallium arsenide, indium, olefin, polyethylene, polytetrafluoroethylene and aluminum nitride.

* * * * *